US011175603B1

(12) United States Patent
Fukaya

(10) Patent No.: US 11,175,603 B1
(45) Date of Patent: Nov. 16, 2021

(54) IMAGE FORMING APPARATUS

(71) Applicant: TOSHIBA TEC KABUSHIKI KAISHA, Tokyo (JP)

(72) Inventor: Hideaki Fukaya, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/068,932

(22) Filed: Oct. 13, 2020

(51) Int. Cl.
*G03G 15/08* (2006.01)
*G03G 15/00* (2006.01)

(52) U.S. Cl.
CPC ..... *G03G 15/086* (2013.01); *G03G 15/5037* (2013.01); *G03G 15/55* (2013.01)

(58) Field of Classification Search
CPC ..... G03G 15/086; G03G 15/0877; G03G 15/0879; G03G 15/55; G03G 15/553; G03G 15/556
See application file for complete search history.

(56) References Cited

U.S. PATENT DOCUMENTS

| | | | | |
|---|---|---|---|---|
| 6,208,816 | B1 | 3/2001 | Koizumi et al. | |
| 6,275,665 | B1 * | 8/2001 | Miyashiro | G03G 15/0856 399/27 |
| 2007/0206966 | A1 * | 9/2007 | Komiya | G03G 15/0889 399/27 |
| 2009/0154942 | A1 | 6/2009 | Hotogi et al. | |
| 2013/0308965 | A1 * | 11/2013 | Tsuchiya | G03G 15/0856 399/27 |
| 2014/0037305 | A1 | 2/2014 | Monde et al. | |
| 2016/0131990 | A1 * | 5/2016 | Kanazawa | G03G 15/086 399/27 |
| 2016/0223950 | A1 * | 8/2016 | Kato | G03G 15/0856 |
| 2016/0252874 | A1 * | 9/2016 | Fujiwara | G03G 21/1676 399/27 |
| 2018/0004124 | A1 * | 1/2018 | Shibukawa | G03G 15/0865 |
| 2018/0364618 | A1 * | 12/2018 | Maeyama | G03G 15/0848 |
| 2019/0187603 | A1 * | 6/2019 | Soda | G03G 15/0867 |
| 2019/0235413 | A1 * | 8/2019 | Kanno | G03G 15/0889 |

FOREIGN PATENT DOCUMENTS

| | | |
|---|---|---|
| JP | 06-161242 | 6/1994 |
| JP | 2000-305348 | 11/2000 |
| JP | 2004-354904 | 12/2004 |
| JP | 2010-107978 | 5/2010 |

* cited by examiner

*Primary Examiner* — Carla J Therrien
(74) *Attorney, Agent, or Firm* — Amin, Turocy & Watson, LLP

(57) ABSTRACT

According to one embodiment, the image forming apparatus includes a storage unit, an image forming unit, a first electrode, a second electrode, a to-be-detected unit, a moving unit, a measuring unit, and a processor. The storage unit stores a recording material. The image forming unit forms an image with the recording material supplied from the storage unit. The to-be-detected unit is in the storage unit and is movable so that at least one of the distance to the first electrode and the distance to the second electrode changes. The moving unit moves the to-be-detected unit in the storage unit. The measuring unit measures the capacitance between the first electrode and the second electrode. The processor controls the image forming unit based on the abnormality detected based on the capacitance.

20 Claims, 8 Drawing Sheets

IMAGE FORMING APPARATUS

FIELD

Embodiments described herein relate generally to an image forming apparatus, a toner monitor, and methods related thereto.

BACKGROUND

In a related art, the conventional image forming apparatus uses a piezoelectric sensor or the like in the sub hopper or the like to detect the presence or absence of toner in the storage unit that stores the toner. However, in the method using the piezoelectric sensor or the like, it is necessary to make a hole in the wall surface of the storage unit, which may cause the toner to leak. In the method using a piezoelectric sensor or the like, the sensor is often expensive. The method using a piezoelectric sensor or the like often consumes a large amount of power.

A method of detecting the presence or absence of toner using a capacitive sensor was also proposed. However, when using the capacitive sensor, there is a problem in that it is not known whether or not toner is present in the initial state.

DETAILED DESCRIPTION

Figure 1:
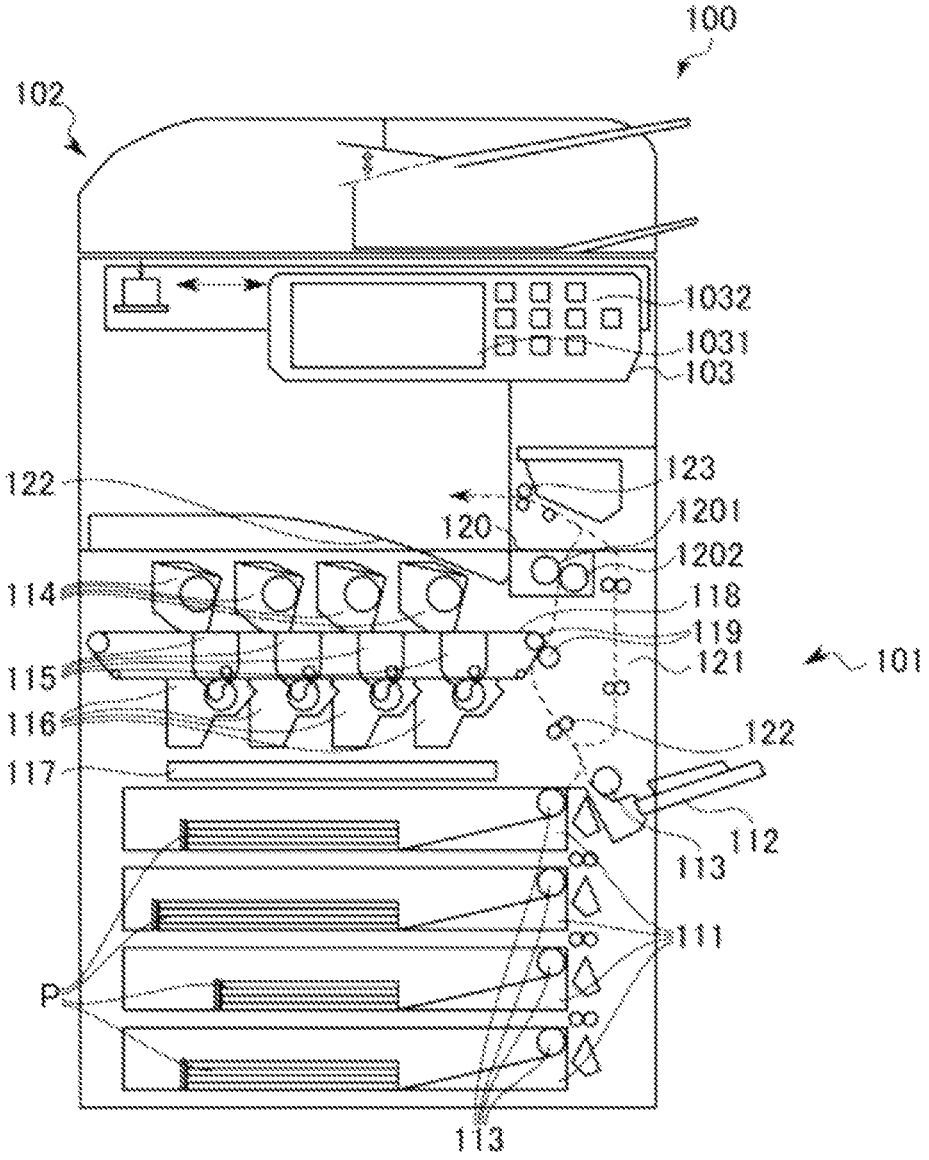
FIG. 1 is a diagram showing an example of a main configuration of an image forming apparatus according to an embodiment.

In general, according to one embodiment, the image forming apparatus includes a storage unit, an image forming unit, a first electrode, a second electrode, a to-be-detected unit, a moving unit, a measuring unit, and a processor. The storage unit stores a recording material. The image forming unit forms an image with the recording material supplied from the storage unit. The to-be-detected unit is in the storage unit and is movable so that at least one of the distance to the first electrode and the distance to the second electrode changes. The moving unit moves the to-be-detected unit which is in the storage unit. The measuring unit measures the capacitance between the first electrode and the second electrode. The processor controls the image forming unit based on the abnormality detected based on the capacitance. According to another embodiment, a method involves forming an image with a recording material supplied from a storage unit; moving a to-be-detected component in the storage unit so that at least one of a distance to a first electrode and a distance to a second electrode changes; measuring a capacitance between the first electrode and the second electrode; and performing control, by a processor, based on an abnormality detected based on the capacitance. According to yet another embodiment, a toner monitor includes a storage unit configured to store toner; a first electrode; a second electrode; a to-be-detected component in the storage unit and movable so that at least one of a distance to the first electrode and a distance to the second electrode changes; a moving component configured to move the to-be-detected component in the storage unit; a measuring component configured to measure a capacitance between the first electrode and the second electrode; and a processor configured to perform control based on an abnormality detected based on the capacitance.

The image forming apparatus according to the embodiment will be described below with reference to the drawings. In each of the drawings used to describe the following embodiments, the scale of each unit may be changed as appropriate. Each drawing used to describe the following embodiments may be illustrated with the configuration omitted for the sake of description. In the drawings and the specification, the same reference numerals indicate similar elements.

FIG. 1 is a diagram illustrating an example of a main configuration of an image forming apparatus 100 according to an embodiment.

The image forming apparatus 100 is, for example, a multifunction peripheral (MFP), a copying machine, a printer, a facsimile, or the like. Hereinafter, the image forming apparatus 100 will be described as an MFP. The image forming apparatus 100 includes, for example, a print function, a scan function, a copy function, a facsimile function, and the like. The print function is a function of forming an image on an image forming medium P or the like using toner as a recording material. The image forming medium P is, for example, a sheet-shaped paper or the like. The scan function is a function of reading an image from a document or the like on which an image is formed. The copy function is a function of printing an image read from a document or the like using the scan function on the image forming medium P using the print function. The image forming apparatus 100 includes, for example, a printer 101, a scanner 102, and an operation panel 103.

The printer 101 prints an image on the image forming medium P by forming an image using toner or the like. The printer 101 includes, for example, an electrophotographic (laser) printer 101 and performs printing by the printer 101. The printer 101 includes, for example, a sheet feed tray 111, a manual feed tray 112, a sheet feed roller 113, a toner cartridge 114, a sub hopper 115, an image forming unit 116, an optical scanning device 117, a transfer belt 118, a secondary transfer roller 119, a fixing unit 120, a duplex unit 121, a conveyance roller 122, and a sheet discharge tray 123.

The sheet feed tray 111 is a tray that stores the image forming medium P used for printing.

The manual feed tray 112 is a tray for manually feeding the image forming medium P.

The sheet feed roller 113 is rotated by the action of a motor to pick up the image forming medium P stored in the sheet feed tray 111 or the manual feed tray 112 from the sheet feed tray 111 or the manual feed tray 112.

The image forming apparatus 100 includes one toner cartridge 114, one sub hopper 115, and one image forming unit 116 as one set and includes one or more sets. As an example, the image forming apparatus 100 includes four toner cartridges 114, four sub hoppers 115, and four image forming units 116, as shown in FIG. 1. The image forming apparatus 100 shown in FIG. 1 includes four such sets. The respective sets correspond to CMYK (cyan, magenta, yellow, and key (black)) toners of respective colors. The image forming apparatus 100 shown in FIG. 1 includes, for example, four such sets including a set corresponding to cyan toner, a set corresponding to magenta toner, a set corresponding to yellow toner, and a set corresponding to black toner. The colors of the toner corresponding to the sets are not limited to the CMYK colors but may be other colors. The toner corresponding to the set may be a special toner. As an example of the special toner, there is a decolorable toner which becomes invisible by decoloring at a temperature higher than the fixing temperature.

The toner cartridge 114 as a retaining unit stores (retains) toner to be supplied to the sub hopper 115. The toner stored in each toner cartridge 114 is a toner of a color corresponding to each toner cartridge 114.

The sub hopper 115 stores the toner supplied from the toner cartridge 114. The sub hopper 115 supplies the stored toner to the image forming unit 116.

Figure 2:
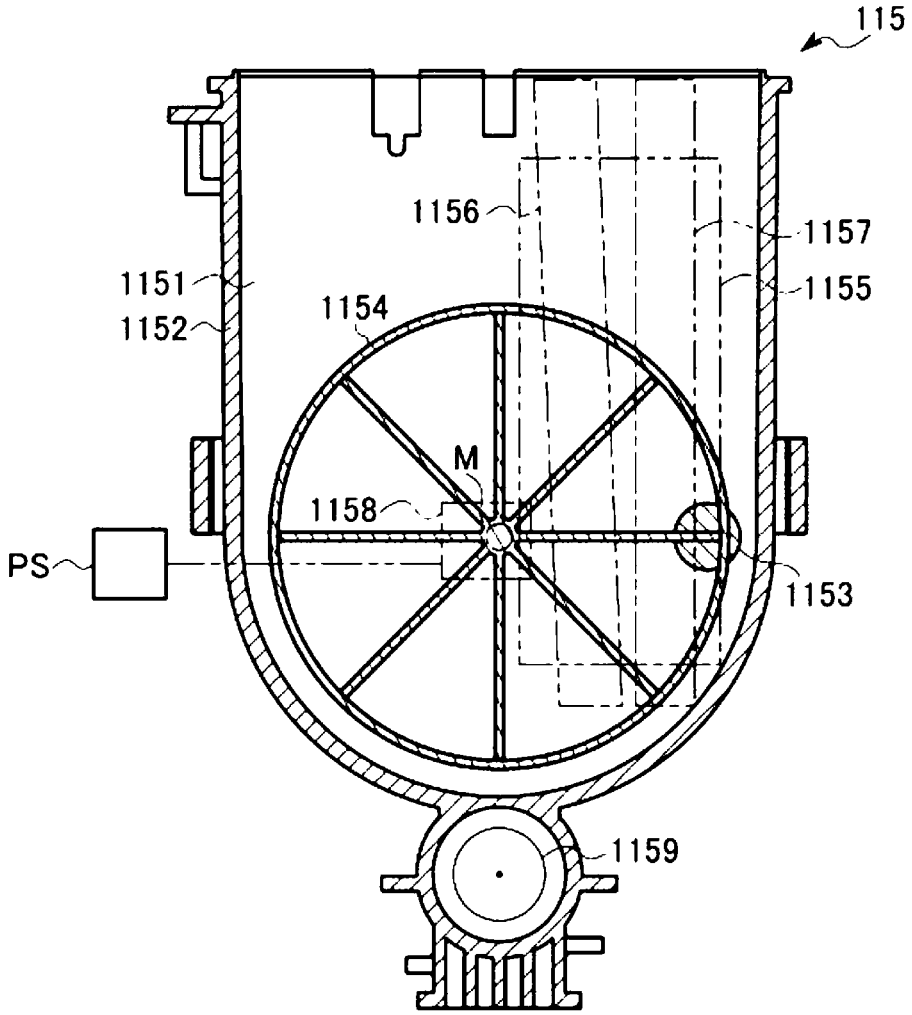
FIG. 2 is a cross-sectional view showing an example of a main configuration of a sub hopper in FIG. 1.

FIG. 2 is a cross-sectional view showing an example of the main configuration of the sub hopper 115. The sub hopper 115 includes, for example, a storage unit 1151, a wall surface 1152, a to-be-detected unit 1153, a rotator 1154, a substrate 1155, a first electrode 1156, a second electrode 1157, and a control circuit 1158.

The storage unit 1151 stores the toner supplied from the toner cartridge 114.

The wall surface 1152 is a wall that surrounds the storage unit 1151. The inside of the wall surface 1152 is the storage unit 1151.

The to-be-detected unit 1153 is made of a dielectric material, for example. The dielectric material is a substance having a high relative dielectric constant, for example. The shape of the to-be-detected unit 1153 is not limited, but is, for example, a sphere, a disc, or a column. The to-be-detected unit 1153 is movable so that the distances to the first electrode 1156 and the second electrode 1157 change. The to-be-detected unit 1153 moves with the rotation of the rotator 1154. A voltage may not be applied to the to-be-detected unit 1153. A current may not be applied to the to-be-detected unit 1153.

The rotator 1154 and the supply unit 1159 are connected to the motor M via a gear or the like. The rotator 1154 and the supply unit 1159 are rotated by the operation of the motor M. The rotator 1154 and the supply unit 1159 may be rotated by different motors.

The rotator 1154 is a circular-shaped member that is rotated by the action of the motor M. The rotator 1154 has the to-be-detected unit 1153 attached to the outside of the rotary axis. When the rotator 1154 rotates, the to-be-detected unit 1153 will move circularly. The rotator 1154 may include two or more to-be-detected units 1153. The rotator 1154 may include a plurality of to-be-detected units 1153 at equal intervals on the same circumference around the rotary axis. The rotator 1154 has a portion having a dielectric constant different from that of other portions on the same circumference around the rotary axis as the to-be-detected unit.

When a plurality of to-be-detected units 1153 are provided at equal intervals on the same circumference around the rotary axis, the weight can be balanced, and thus the rotation of the rotator 1154 is less likely to shake. The rotator 1154 may be attached with a counterweight or the like to balance the weight. Alternatively, the weight of the rotator 1154 may be heavy on the side opposite to the attachment position of the to-be-detected unit 1153 in order to balance the weight.

The substrate 1155 is attached to the outside of the wall surface 1152. The substrate 1155 includes a circuit for measuring the capacitance between the first electrode 1156 and the second electrode 1157. The substrate 1155 outputs a capacitance signal indicating the capacitance. The substrate 1155 includes a capacitive sensor that measures capacitance.

The substrate 1155 is an example of the measuring unit that measures the capacitance between the first electrode 1156 and the second electrode 1157. Alternatively, a portion including a circuit, a wiring, or the like for connecting the substrate 1155 and another portion on the substrate 1155 is an example of the measuring unit.

The first electrode 1156 and the second electrode 1157 are patterns on the substrate 1155, for example. Alternatively, the first electrode 1156 and the second electrode 1157 are conductor tapes attached to the outside of the wall surface 1152. The conductor tape is electrically connected to the wiring on the substrate 1155. The first electrode 1156 and the second electrode 1157 are not in contact with each other and are apart from each other.

The control circuit 1158 is a circuit that controls the motor M. The control circuit 1158 is connected to a power supply PS.

The power supply PS supplies electric power to the motor M via the control circuit 1158.

The supply unit 1159 is a circular-shaped member that rotates by the action of the motor M. By rotating the supply unit 1159, the toner in an amount corresponding to the rotation amount of the supply unit 1159 is sent from the storage unit 1151 to the image forming unit 116.

The image forming unit 116 forms an image with toner and transfers the image to the transfer belt 118 (primary transfer).

Figure 3:
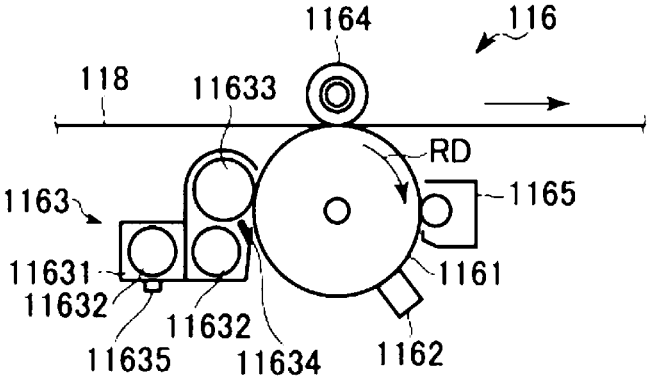
FIG. 3 is a diagram showing an example of a main configuration of an image forming unit in FIG. 1.

FIG. 3 is a diagram showing an example of a main configuration of the image forming unit 116. The image forming unit 116 includes, for example, a photosensitive drum 1161, a charging unit 1162, a developing unit 1163, a primary transfer roller 1164, and a cleaner 1165.

The optical scanning device 117 emits a beam to form an electrostatic latent image on the surface of the photosensitive drum 1161.

The charging unit 1162 charges the surface of the photosensitive drum 1161 with a positive charge.

The developing unit 1163 uses the toner supplied from the sub hopper 115 to develop the electrostatic latent image on the surface of the photosensitive drum 1161, thereby forming an image with the toner. The developing unit 1163 includes, for example, a developer container 11631, a stirring mechanism 11632, a developing roller 11633, a doctor blade 11634, and a toner sensor 11635.

The developer container 11631 is a container for storing the developer. The developer is, for example, a developer including two components, a toner, and a carrier. The developer container 11631 receives the toner sent from the sub hopper 115 by the action of the rotator 1154. The carrier is stored in the developer container 11631 when the image forming apparatus 100 is manufactured or set up.

The stirring mechanism 11632 is driven by a motor to stir the toner and the carrier in the developer container 11631.

The developing roller 11633 rotates in the developer container 11631. As a result, the developer adheres to the surface of the developing roller 11633.

The doctor blade 11634 is a member that is arranged at a distance from the surface of the developing roller 11633. In order to form a layer of the developer having a thickness corresponding to the distance between the doctor blade 11634 and the surface of the developing roller 11633 on the surface of the developing roller 11633, the doctor blade 11634 removes some of the developer attached to the surface of the rotating developing roller 11633.

The toner sensor 11635 is, for example, a magnetic flux sensor including a coil and detecting the voltage value generated in the coil. The detected voltage of the toner sensor 11635 changes depending on the density of magnetic flux from the toner in the developer container 11631. The toner sensor 11635 outputs a voltage corresponding to the concentration of toner in the developer in the developer container 11631 (hereinafter, simply referred to as "toner concentration"). The voltage output by the toner sensor 11635 is used to measure the toner concentration in the developer container 11631.

The primary transfer roller 1164 generates a transfer voltage between the primary transfer roller 1164 and the photosensitive drum 1161 in order to transfer (primary transfer) the image formed on the surface of the photosensitive drum 1161 onto the transfer belt.

The cleaner 1165 removes the toner remaining on the surface of the photosensitive drum 1161.

The optical scanning device 117 is also called a laser scanning unit (LSU) or the like. The optical scanning device 117 forms an electrostatic latent image on the surface of the photosensitive drum of each image forming unit 116 by controlling the laser light according to the input image data.

The transfer belt 118 is, for example, an endless belt and can be rotated by the action of a roller. The transfer belt 118 rotates to convey the image transferred from each image forming unit 116 to the position of the secondary transfer roller 119.

The secondary transfer roller 119 includes two rollers facing each other. The secondary transfer roller 119 transfers (secondarily transfers) the image formed on the transfer belt 118 onto the image forming medium P passing between the secondary transfer rollers 119.

The fixing unit 120 heats and pressurizes the image forming medium P onto which the image is transferred in order to fix the image transferred onto the image forming medium P. The fixing unit 120 is equipped with a heating unit 1201 and a pressure roller 1202 that face each other. The fixing unit 120 includes, for example, a heating unit 1201 and a pressure roller 1202.

The heating unit 1201 is, for example, a roller provided with a heat source for heating the heating unit 1201. The heat source is, for example, a heater. The roller heated by the heat source heats the image forming medium P.

The heating unit 1201 may include an endless belt suspended by a plurality of rollers. For example, the heating unit 1201 includes a plate heat source, an endless belt, a belt conveyance roller, a tension roller, and a press roller. The endless belt is, for example, a film-shaped member. The belt conveyance roller drives the endless belt. The tension roller gives tension to the endless belt. The press roller has an elastic layer formed on the surface thereof. The plate-shaped heat source has the heat-generating unit contacting the inside of the endless belt and is pressed in the press roller direction to form a nip between the plate-shaped heat source and the press roller.

The pressure roller 1202 presses the image forming medium P passing between the pressure roller 1202 and the heating unit 1201.

The duplex unit 121 makes the image forming medium P ready for printing on the back side. For example, the duplex unit 121 reverses the front and back of the image forming medium P by switching back the image forming medium P using a roller or the like.

The conveyance roller 122 conveys the image forming medium P by rotating by the action of a motor.

The sheet discharge tray 123 is a base on which the image forming medium P for which printing was completed is discharged.

The scanner 102 reads an image from a document or the like. The scanner 102 is, for example, an optical reduction system including an imaging element such as a charge-coupled device (CCD) image sensor. Alternatively, the scanner 102 is a contact image sensor (CIS) system including an imaging element such as a complementary metal-oxide-semiconductor (CMOS) image sensor. Alternatively, the scanner 102 may be of any other known system.

The operation panel 103 includes a man-machine interface that performs input and output between the image forming apparatus 100 and an operator of the image forming apparatus 100. The operation panel 103 includes, for example, a touch panel 1031, an input device 1032, a speaker, and the like.

The touch panel 1031 is formed by stacking a display such as a liquid crystal display or an organic electro-luminescence (EL) display, and a pointing device by touch input. The display included in the touch panel 1031 functions as a display device that displays a screen for notifying the operator of the image forming apparatus 100 of various information. The touch panel 1031 functions as an input device that receives a touch operation by the operator.

The input device 1032 receives an operation by the operator of the image forming apparatus 100. The input device 1032 is, for example, a keypad or a touchpad.

Figure 4:
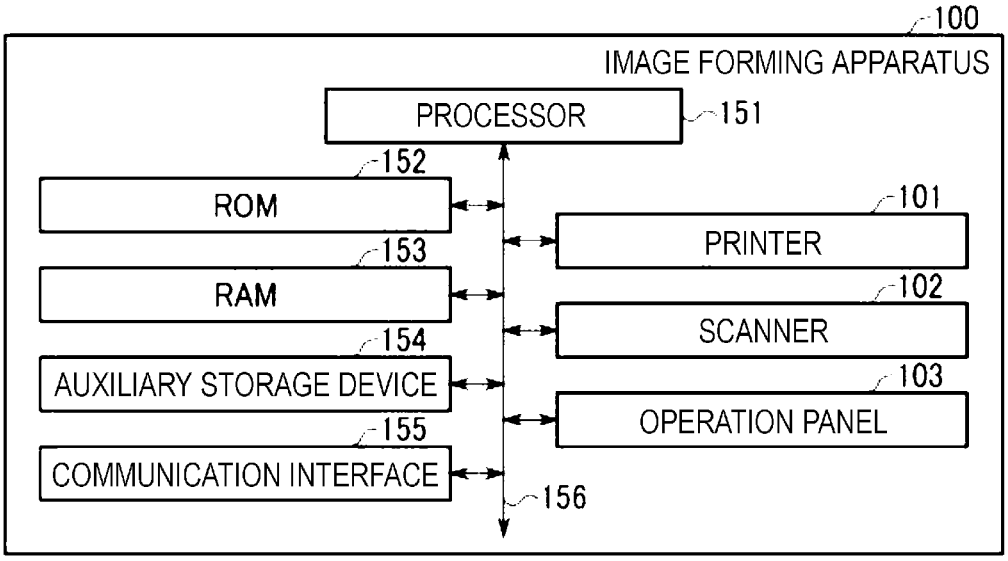
FIG. 4 is a block diagram showing an example of a main circuit configuration of the image forming apparatus.

FIG. 4 is a block diagram showing an example of a main circuit configuration of the image forming apparatus 100.

The image forming apparatus 100 includes, for example, a processor 151, a read-only memory (ROM) 152, a random-access memory (RAM) 153, an auxiliary storage device 154, a communication interface 155, the printer 101, the scanner 102, and the operation panel 103. Then, a bus 156 or the like connects these units.

The processor 151 corresponds to a central part of a computer that performs processing such as calculation and control necessary for the operation of the image forming apparatus 100. The processor 151 controls each unit to realize various functions of the image forming apparatus 100 based on programs such as firmware, system software, and application software stored in the ROM 152 or the auxiliary storage device 154. The processor 151 executes the process described below based on the program. Part or all of the program may be incorporated in the circuit of the processor 151. The processor 151 is, for example, a central processing unit (CPU), a micro processing unit (MPU), a system on a chip (SoC), a digital signal processor (DSP), a graphics processing unit (GPU), an application specific integrated circuit (ASIC), a programmable logic device (PLD) or a field-programmable gate array (FPGA). Alternatively, the processor 151 is a combination of a plurality of these.

The ROM 152 corresponds to the main storage device of a computer having the processor 151 as the center. The ROM 152 is a non-volatile memory used exclusively for reading data. The ROM 152 stores, for example, the firmware of the above programs. The ROM 152 also stores data used by the processor 151 to perform various processes.

The RAM 153 corresponds to the main storage device of a computer having the processor 151 as the center. The RAM 153 is a memory used for reading and writing data. The RAM 153 is used as a work area for storing data that is temporarily used by the processor 151 in performing various processes. The RAM 153 is typically a volatile memory.

The auxiliary storage device 154 corresponds to the auxiliary storage device of a computer having the processor 151 as the center. The auxiliary storage device 154 is, for example, an electric erasable programmable read-only memory (EEPROM), a hard disk drive (HDD), a flash memory, or the like. The auxiliary storage device 154 stores, for example, system software and application software among the above programs. The auxiliary storage device 154 stores data used by the processor 151 in performing various processes, data generated by the process of the processor 151, various setting values, and the like. The image forming apparatus 100 may include, as the auxiliary storage device 154, an interface into which a removable storage medium such as a memory card or a universal serial bus (USB) memory can be inserted. The interface reads/writes information from/to the storage medium.

The auxiliary storage device 154 stores a threshold THa to a threshold THc.

The communication interface 155 is an interface for the image forming apparatus 100 to communicate via a network such as the Internet or a local area network (LAN).

The bus 156 includes a control bus, an address bus, a data bus, and the like, and transmits signals transmitted and received by each unit of the image forming apparatus 100.

The operation of the image forming apparatus 100 according to the embodiment will be described below.

Figure 5:
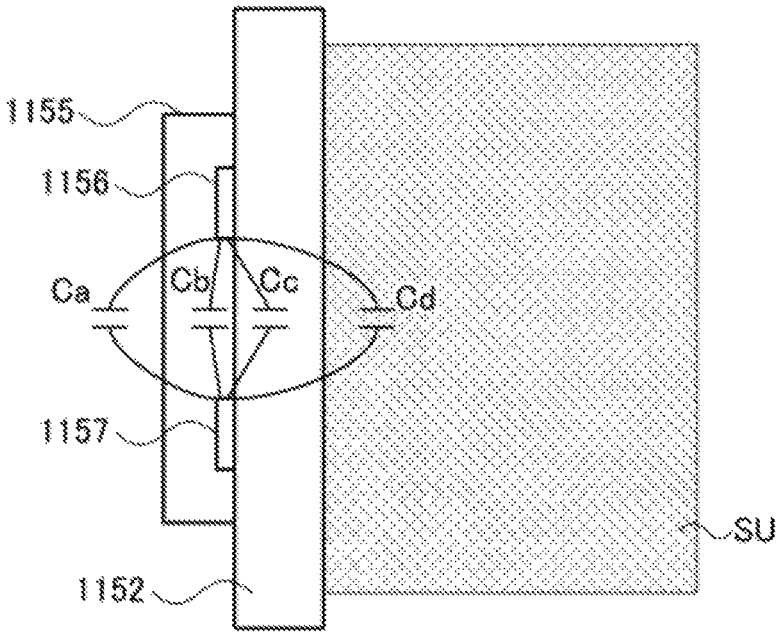
FIG. 5 is a diagram showing a model of the capacitance C between a first electrode and a second electrode in FIG. 2.

FIG. 5 is a diagram showing a model of the capacitance C between the first electrode 1156 and the second electrode 1157.

The capacitance C between the first electrode 1156 and the second electrode 1157 can be considered as capacitance in which a capacitor having a capacitance Ca, a capacitor having a capacitance Cb, a capacitor having a capacitance Cc and a capacitor having a capacitance Cd are connected in parallel as shown in FIG. 5. That is, the capacitance C can be expressed by:

$$C \approx Ca+Cb+Cc+Cd \quad (1)$$

The capacitance Ca is the capacitance of the portion indicated by the lines of electric force passing through the outside of the sub hopper 115. The lines of electric force mainly pass through the air.

The capacitance Cb is the capacitance of the portion indicated by the lines of electric force passing through the inside of the substrate 1155.

The capacitance Cc is the capacitance of the portion indicated by the lines of electric force passing through the inside of the wall surface 1152.

The capacitance Cd is the capacitance of a portion indicated by the lines of electric force passing from the first electrode 1156 to the second electrode 1157 through the wall surface 1152, the substance SU inside the wall surface 1152 (in the storage unit 1151), and the wall surface 1152 in this order.

Among the capacitances Ca to Cd, the capacitances Ca to Cc do not change regardless of the presence or absence and amount of toner in the storage unit 1151 and are therefore ignored here.

Figure 6:
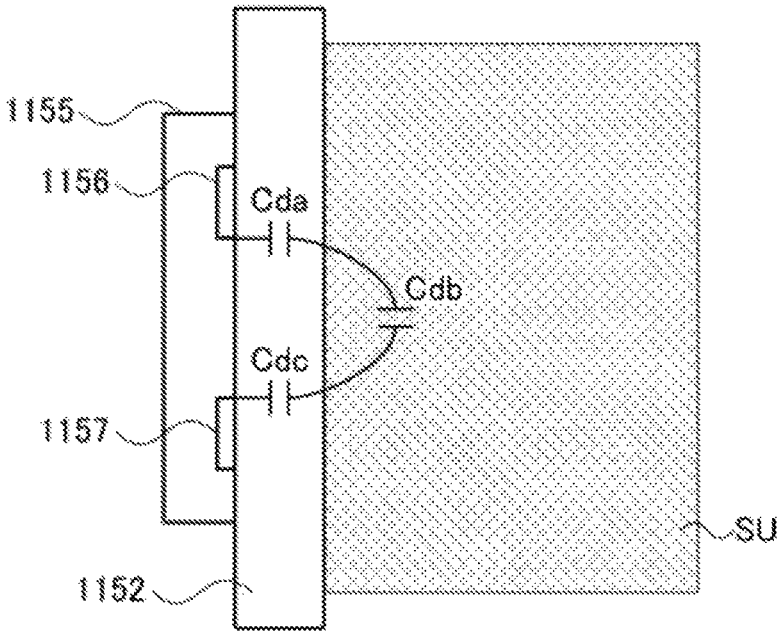
FIG. 6 is a diagram showing a model of the capacitance Cd.

FIG. 6 is a diagram showing a model of the capacitance Cd.

The capacitance Cd can be considered as a capacitance in which a capacitor having a capacitance Cda, a capacitor having a capacitance Cdb, and a capacitor having a capacitance Cdc are connected in series as shown in FIG. 6. That is, the capacitance Cd can be expressed by:

$$Cd \approx 1/(1/Cda+1/Cdb+1/Cdc) \quad (2)$$

The capacitance Cda is a capacitance shown by the portion passing through the inside of the wall surface 1152 from the first electrode 1156 to the inner wall of the wall surface 1152 among the lines of electric force passing from the first electrode 1156 to the second electrode 1157 through the inside of the wall surface 1152, the substance SU in the storage unit 1151, and the inside of the wall surface 1152 in this order.

The capacitance Cdb is a capacitance shown by the portion passing through the substance SU in the storage unit 1151 among the lines of electric force passing from the first electrode 1156 to the second electrode 1157 through the inside of the wall surface 1152, the substance SU in the storage unit 1151, and the inside of the wall surface 1152 in this order.

The capacitance Cdc is a capacitance shown by the portion passing through the inside of the wall surface 1152 from the second electrode 1157 to the inner wall of the wall surface 1152 among the lines of electric force passing from the first electrode 1156 to the second electrode 1157 through the inside of the wall surface 1152, the substance SU in the storage unit 1151, and the inside of the wall surface 1152 in this order.

Among the capacitances Cda to Cdc, the capacitances Cda and Cdc do not change regardless of the presence or absence and amount of toner in the storage unit 1151 and are therefore ignored here.

Figure 7:
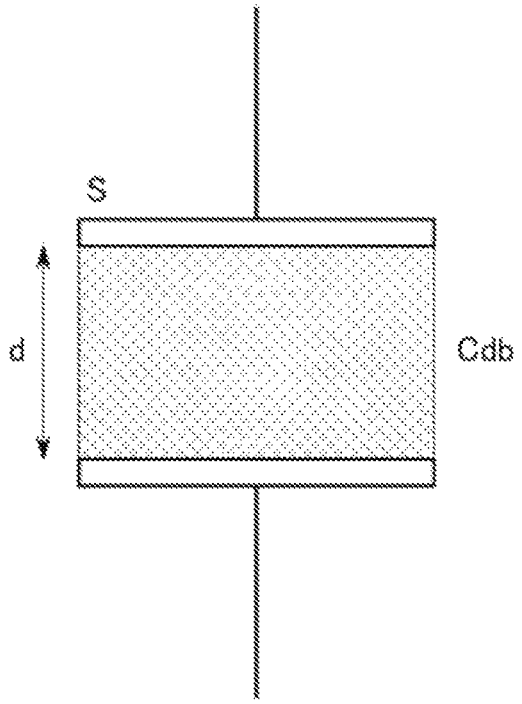
FIG. 7 is a diagram in which the capacitance Cdb when a to-be-detected unit in FIG. 2 is sufficiently separated from the first electrode and the second electrode in FIG. 2 is replaced with a parallel plate capacitor model.

FIG. 7 is a diagram in which the capacitance Cdb when the to-be-detected unit 1153 is sufficiently separated from the first electrode 1156 and the second electrode 1157 is replaced with a parallel plate capacitor model.

When the to-be-detected unit 1153 is sufficiently separated from the first electrode 1156 and the second electrode 1157, the presence of the to-be-detected unit 1153 has almost no effect on the capacitance Cdb and thus the capacitance Cdb can be obtained by ignoring the presence of the to-be-detected unit 1153.

In this model, for the simplification of the calculation, the capacitance Cdb capacitor is regarded as a parallel plate capacitor.

Therefore, the capacitance Cdb when the to-be-detected unit 1153 is sufficiently separated from the first electrode 1156 and the second electrode 1157 can be expressed as follows with an assumption that the distance between the parallel plates is d, the area of the parallel plate is S, the vacuum dielectric constant is $\varepsilon_0$, and the relative dielectric constant of the substance SU is $\varepsilon$:

$$Cdb \approx \varepsilon_0 \varepsilon S/d \quad (3)$$

Figure 8:
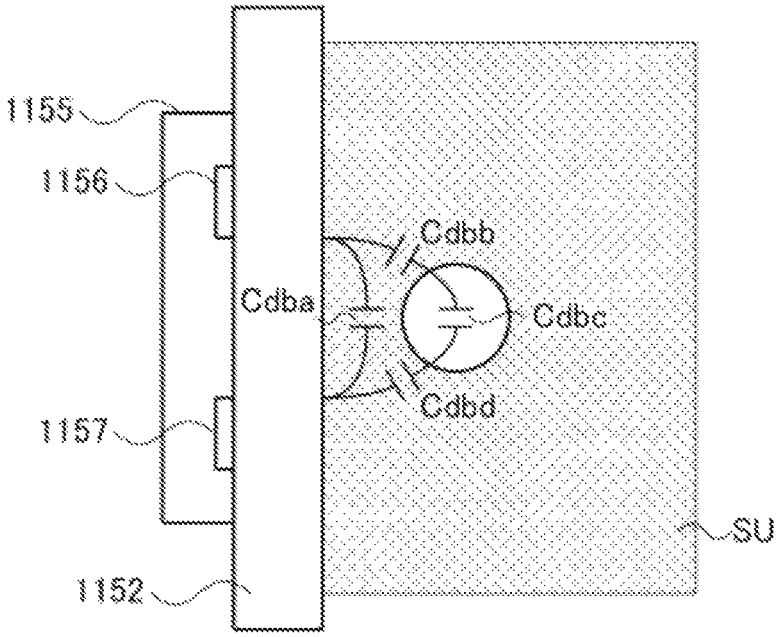
FIG. 8 is a diagram showing a model of the capacitance Cdb in a state where the to-be-detected unit in FIG. 2 is closest to the first electrode and the second electrode in FIG. 2.

FIG. 8 is a diagram showing a model of the capacitance Cdb in a state where the to-be-detected unit 1153 is closest to the first electrode 1156 and the second electrode 1157.

When the to-be-detected unit 1153 is present, the capacitance Cdb can be considered to be a capacitance in which a capacitor having a capacitance Cdba at the portion where the lines of electric force do not pass through the to-be-detected unit 1153 but only through the substance SU, and a capacitor at the portion where the lines of electric force pass the to-be-detected unit 1153 are connected in parallel.

The capacitance of the capacitor at the portion where the lines of electric force pass through the to-be-detected unit 1153 can be considered as a capacitance in which a capacitor having a capacitance Cdbb, a capacitor having a capacitance Cdbc, and a capacitor having a capacitance Cdbd are connected in series. That is, the capacitance Cdb can be expressed by:

$$Cdb \approx Cdba + 1/(1/Cdbb + 1/Cdbc + 1/Cdbd) \quad (4)$$

The capacitance Cdbb is the capacitance Cdbc of the portion indicated by the lines of electric force passing through only the substance SU from the inner wall of the wall surface 1152 to the to-be-detected unit 1153.

The capacitance Cdbc is the capacitance of the portion indicated by the lines of electric force passing through only the inside of the to-be-detected unit 1153.

The capacitance Cdbd is the capacitance of the portion indicated by the lines of electric force passing through only the inside of the substance SU from the to-be-detected unit 1153 to the inner wall of the wall surface 1152.

Figure 9:
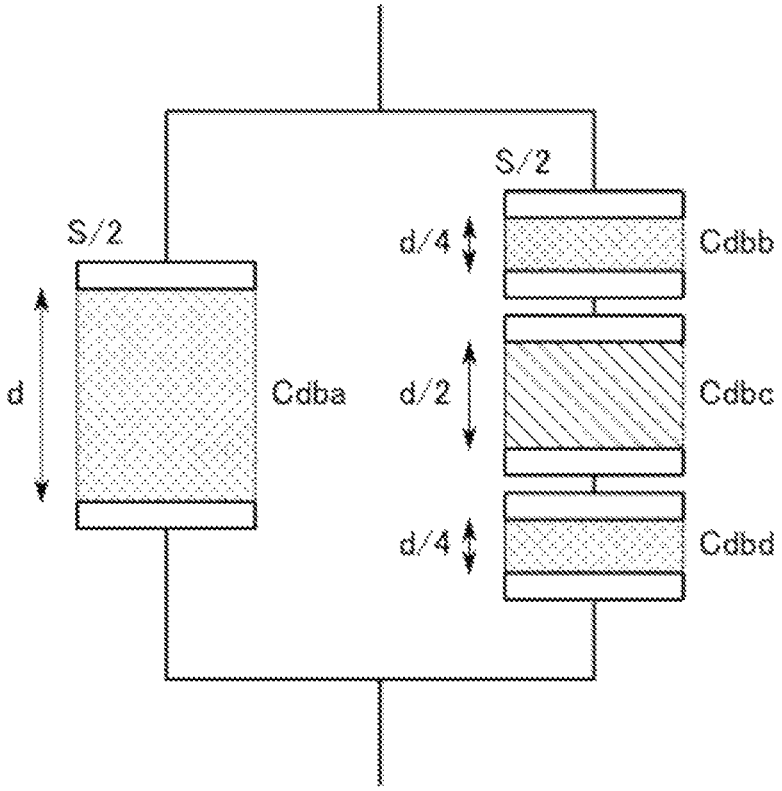
FIG. 9 is a diagram in which the capacitance Cdb in the state where the to-be-detected unit in FIG. 2 is closest to the first electrode and the second electrode in FIG. 2 is replaced with a parallel plate capacitor model.

FIG. 9 is a diagram in which the capacitance Cdb in the state where the to-be-detected unit 1153 is closest to the first electrode 1156 and the second electrode 1157 is replaced with a parallel plate capacitor model.

In the model shown in FIG. 9, the area of the parallel plate of respective parallel plate capacitors having the capacitance Cdba to the capacitance Cdbd is set to S/2 to simplify the calculation. In the model shown in FIG. 9, the distance between the parallel plates of the capacitor having the capacitance Cdba is set to d. In the model shown in FIG. 9, the distance between the parallel plates of the capacitor having the capacitance Cdbb is d/4, the distance between the parallel plates of the capacitor having the capacitance Cdbc is set to d/2, and the distance between the parallel plates of the capacitor having the capacitance Cdbd is set to d/4. In this case, when the dielectric constant of the to-be-detected unit 1153 is ER, the capacitance Cdb can be expressed by:

$$Cdb \approx \varepsilon\varepsilon_0 S/2d + 1/(1/(2\varepsilon\varepsilon_0 S/d) + 1/(\varepsilon_R\varepsilon_0 S/d) + 1/(2\varepsilon\varepsilon_0 S/d)) \quad (5)$$

When Equation (5) is arranged, it becomes:

$$Cdb \approx (1/2 + \varepsilon_R/(\varepsilon + \varepsilon_R))\varepsilon\varepsilon_0(S/d) \quad (6)$$

From the above, the difference Cdif between the capacitance Cdb when the to-be-detected unit 1153 is sufficiently separated from the first electrode 1156 and the second electrode 1157, and the capacitance Cdb in the state where the to-be-detected unit 1153 is closest to the first electrode 1156 and the second electrode 1157 can be expressed, from Equations (3) and (6), by:

$$Cdif \approx (1/2 + \varepsilon_R/(\varepsilon + \varepsilon_R))\varepsilon\varepsilon_0(S/d) - \varepsilon_0\varepsilon S/d \quad (7)$$

When Equation (7) is arranged, it becomes:

$$Cdif \approx (\varepsilon_R/(\varepsilon + \varepsilon_R) - 1/2)\varepsilon\varepsilon_0(S/d) \quad (8)$$

From Equation (8), it can be understood that the higher the relative dielectric constant of the substance SU, the larger the amount of change in the capacitance C due to the movement of the to-be-detected unit 1153. Since the relative dielectric constant of toner is higher than the relative dielectric constant of air, when the storage unit 1151 is filled with toner, the amount of change in the capacitance C due to the movement of the to-be-detected unit 1153 increases more than when the storage unit 1151 is empty.

From Equation (8), it can be understood that the higher the relative dielectric constant of the to-be-detected unit 1153, the larger the amount of change in the capacitance C due to the movement of the to-be-detected unit 1153.

Figure 10:
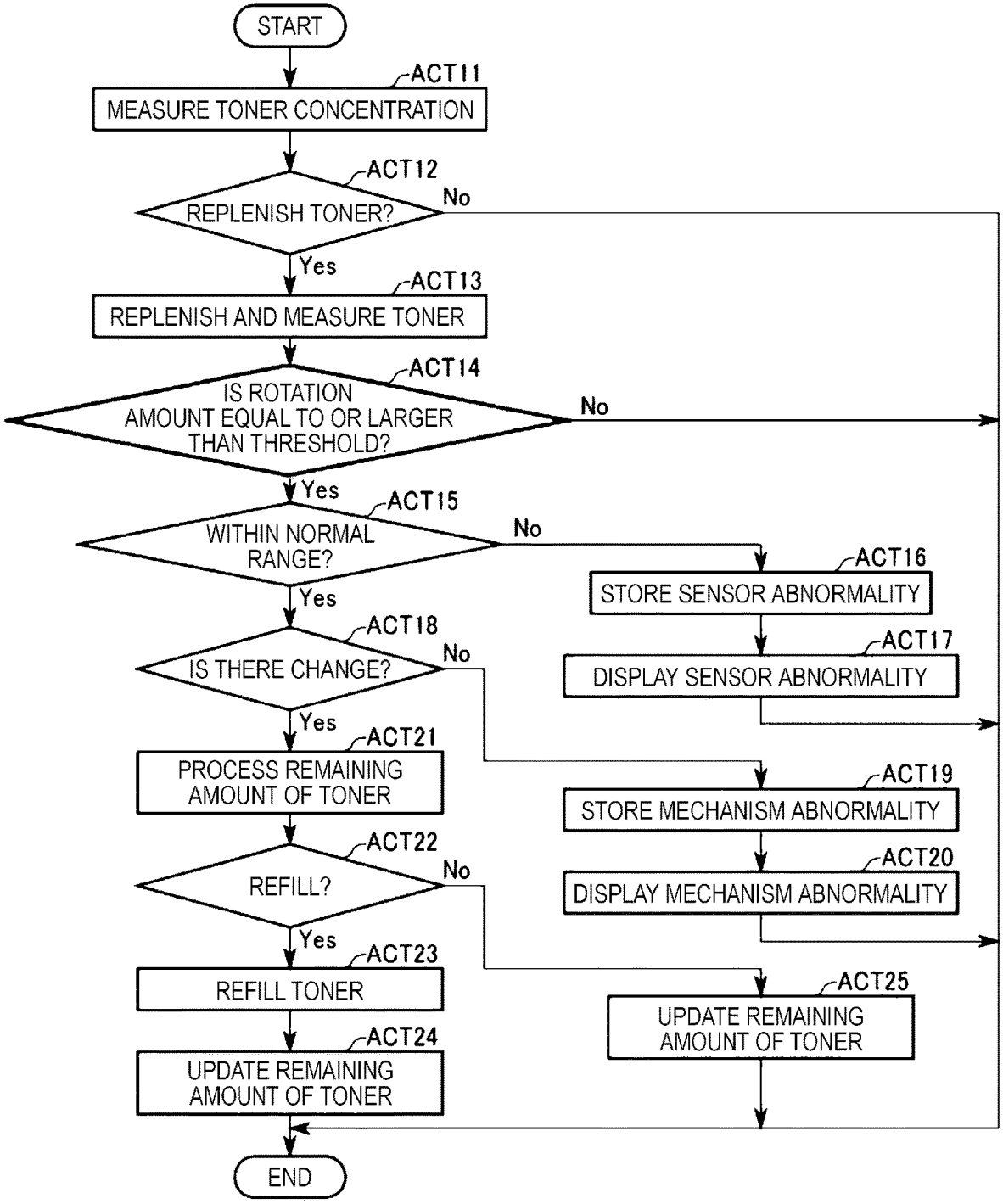
FIG. 10 is a flowchart showing an example of processing by a processor 151 in FIG. 4.

FIG. 10 is a flowchart showing an example of processing by the processor 151 of the image forming apparatus 100. The processor 151 executes the processing of FIG. 10 based on a program stored in the ROM 152 or the auxiliary storage device 154, for example.

The processor 151 starts the processing shown in FIG. 10, for example, when the execution of the print function is completed. This is because the toner concentration is reduced by executing the print function. The processor 151 performs the processing shown in FIG. 10 for each color of CMYK.

In ACT 11, the processor 151 uses the toner sensor 11635 to measure the toner concentration in the developer container 11631.

In ACT 12, the processor 151 determines whether or not to replenish the toner to the developer container 11631. The processor 151 determines to replenish the toner, for example, when the toner concentration is equal to or lower than a predetermined concentration. If it is not determined to replenish the toner to the developer container 11631, the processor 151 determines No in ACT 12 and ends the processing illustrated in FIG. 10. If it is determined to replenish the toner to the developer container 11631, the processor 151 determines Yes in ACT 12 and proceeds to ACT 13.

In ACT 13, the processor 151 operates the motor M to rotate the rotator 1154 and the supply unit 1159, thereby replenishing the developer container 11631 with the toner. The processor 151 measures the capacitance C using the substrate 1155 at the same time as or in parallel with the toner replenishment. The processor 151 measures the rotation amount of the rotator 1154 in ACT 13. For example, the processor 151 measures the rotation amount using the operating time of the motor M and the like.

In ACT 14, the processor 151 determines whether or not the rotation amount of the rotator 1154 is equal to or greater than a predetermined rotation amount. For example, the processor 151 determines that the rotation amount of the rotator 1154 is equal to or greater than the predetermined rotation amount when the operating time of the motor M is equal to or greater than a predetermined time. If the processor 151 determines that the rotation amount of the rotator 1154 is less than the predetermined rotation amount, the processor 151 determines No in ACT 14 and ends the processing shown in FIG. 10. If the processor 151 determines that the rotation amount of the rotator 1154 is equal to or greater than the predetermined rotation amount, the processor 151 determines Yes in ACT 14 and proceeds to ACT 15.

In ACT 15, the processor 151 determines whether or not the measurement result of the capacitance C is within the normal range.

Figure 11:
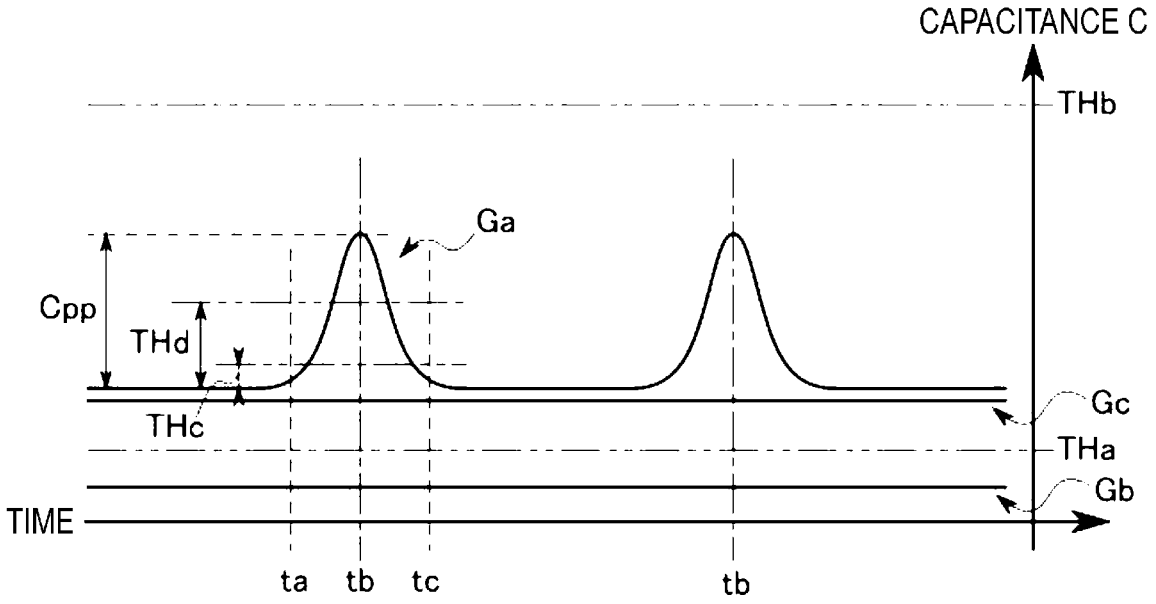
FIG. 11 is a graph showing the change over time in the capacitance C.

FIG. 11 is a graph showing the time change of the capacitance C. FIG. 11 shows three graphs, a graph Ga to a graph Gc. The graph Ga is an example of a graph when the measurement can be performed normally.

In the graph Ga, near the time ta to the time tc, the to-be-detected unit 1153 approaches the first electrode 1156 and the second electrode 1157, and thus, the capacitance C increases. At time tb, the to-be-detected unit 1153 comes closest to the first electrode 1156 and the second electrode 1157, and thus, the capacitance C becomes the largest. After the to-be-detected unit 1153 comes closest to the first electrode 1156 and the second electrode 1157 at time tb, the to-be-detected unit 1153 also comes closest to the first electrode 1156 and the second electrode 1157 at time td. The capacitance C increases periodically in the cycle of (td–tb).

FIG. 11 also shows the change amount Cpp of the capacitance C. The change amount Cpp is, for example, peak-to-peak as shown in FIG. 11.

The graph Gb is an example of a graph showing an abnormal value in which the measurement result of the capacitance C is outside the normal range. When the measurement result of the capacitance C is in the range of the threshold THa or more and the threshold THb or less, the measurement result is within the normal range. When the measurement result of the capacitance C is less than the threshold THa or exceeds the threshold THb, the measurement result is an abnormal value. The threshold THa and the threshold THb are predetermined by, for example, the manufacturer, the designer, or the administrator of the image forming apparatus 100.

For example, when the measurement result of the capacitance C becomes less than the threshold THa or exceeds the threshold THb even for a moment, the processor 151 determines that the measurement result of the capacitance C is out of the normal range. For example, the processor 151 determines that the measurement result of the capacitance C is outside the normal range when the measurement result is less than the threshold THa or exceeds the threshold THb for continuously a predetermined time or more. For example, the processor 151 determines that the measurement result of the capacitance C is outside the normal range when the measurement result becomes less than the threshold THa or exceeds the threshold THb for a predetermined time or more within a certain time.

The threshold THb may not be set. The normal range may be equal to or greater than the threshold THa and have no upper limit. The threshold THa may not be set. The normal range may be 0 or more and the threshold THb or less. The threshold THb is an example of a first threshold. The threshold THa is an example of a second threshold.

If the processor 151 determines that the measurement result of the capacitance C is outside the normal range, the processor 151 determines Yes in ACT 15 and proceeds to ACT 16.

If the measurement result of the capacitance C is outside the normal range, it can be considered that there is an abnormality in the measurement of the capacitance C. This abnormality is, for example, an abnormality of the capacitive sensor that measures the capacitance C. This abnormality is, for example, an abnormality in a circuit or a wiring that connects the capacitive sensor to another portion. The circuit or the wiring is, for example, a circuit in the substrate 1155, and a wiring and a circuit connecting the substrate 1155 and the processor 151. For example, when the capacitive sensor, the circuit, the wiring, or the like is broken or short-circuited, the measured value of the capacitance C may be abnormally low or high.

In ACT 16, the processor 151 stores, in the auxiliary storage device 154 or the like, a value indicating that there is an abnormality in the capacitive sensor or the circuit that connects the capacitive sensor and other portions. By referring to the value later, the processor 151 can understand that there is an abnormality in the capacitive sensor or the circuit connecting the capacitive sensor and other portions.

In ACT 17, the processor 151 notifies the operator or the administrator of the image forming apparatus 100 that the capacitive sensor has an abnormality. The processor 151, for example, controls the touch panel 1031 to display an image indicating that the capacitive sensor has an abnormality on the touch panel 1031 to notify the abnormality. The processor 151 may notify by outputting a sound indicating that the capacitive sensor has an abnormality from the speaker. The processor 151 may notify by transmitting information indicating that the capacitive sensor has an abnormality, to another computer, or the like via the communication interface 155 or the like. The computer that received the information displays, for example, an image indicating that the capacitive sensor has an abnormality. After the process of ACT 17, the processor 151 ends the processing shown in FIG. 10.

The processor 151 functions as an example of a notification unit that cooperates with the operation panel 103 or the communication interface 155 by performing the process of ACT 17 to notify that there is an abnormality in the capacitance measurement (capacitive sensor).

As described above, the processor 151 performs the processes of ACT 15 to ACT 17 to perform control based on the abnormality detected based on the capacitance C.

If the processor 151 determines that the measurement result of the capacitance C is within the normal range, the processor 151 determines No in ACT 15 and proceeds to ACT 18.

In ACT 18, the processor 151 determines whether or not the measured value of the capacitance C is changing periodically.

The graph Gc shown in FIG. 11 is an example of a graph in which the measured value of the capacitance C is not changed. The measured value shown in the graph Gc is within the normal range.

The processor 151 determines that the measured value of the capacitance C does not change periodically, for example, when the change amount of the capacitance C is equal to or less than a predetermined change amount. For example, the processor 151 determines that the change amount of the capacitance C is equal to or less than the predetermined change amount when the change amount Cpp is equal to or less than the threshold THc. The threshold THc is a predetermined value for determining that the change amount of the capacitance C is equal to or less than the predetermined change amount. The threshold THc is set in advance by, for example, the manufacturer, the designer, or the administrator of the image forming apparatus 100.

The processor 151 determines that the measured value of the capacitance C does not change periodically if the cycle is not constant even though the measured value of the capacitance C changes.

If the processor 151 determines that the measured value of the capacitance C does not change periodically, the processor 151 determines No in ACT 18 and proceeds to ACT 19.

If the measured value of the capacitance C does not change, for example, it is considered that the mechanism for rotating the to-be-detected unit 1153 (hereinafter, referred to as "rotation mechanism") has an abnormality. The rotation mechanism includes the rotator 1154, the control circuit 1158, the motor M, and the power supply PS. The rotation mechanism is an example of a moving unit that moves the to-be-detected unit 1153. For example, when the circular motion of the to-be-detected unit 1153 is stopped or the to-be-detected unit 1153 is hardly moving due to an abnormality in the rotation mechanism, the capacitance C does not change or the change amount is small. When the rotation mechanism has an abnormality and the circular motion of the to-be-detected unit 1153 is not periodic, the change in the capacitance C is not periodic.

In ACT 19, the processor 151 stores a value indicating that the rotation mechanism has an abnormality in the auxiliary storage device 154 or the like. By referring to the value later, the processor 151 can know that the rotation mechanism has an abnormality.

In ACT 20, the processor 151 notifies the operator or the administrator of the image forming apparatus 100 that the rotation mechanism has an abnormality. The processor 151, for example, controls the touch panel 1031 to display an image indicating that the rotation mechanism has an abnormality on the touch panel 1031 to notify the abnormality. The processor 151 may notify by outputting a sound indicating that the rotation mechanism has an abnormality from the speaker. The processor 151 may notify by transmitting information indicating that the rotation mechanism has an abnormality to another computer or the like via the communication interface 155 or the like. The computer that received the information displays, for example, an image indicating that the rotation mechanism has an abnormality. After the process of ACT 20, the processor 151 ends the processing shown in FIG. 10.

By performing the process of ACT 20, the processor 151 functions as an example of a notification unit that cooperates with the operation panel 103 or the communication interface 155 to notify that there is an abnormality in the capacitance measurement (rotation mechanism).

As described above, the processor 151 performs the processes of ACT 18 to ACT 20 to perform control based on the abnormality detected based on the capacitance C.

If the measured value of the capacitance C is changing, the processor 151 determines Yes in ACT 18 and proceeds to ACT 21.

In ACT 21, the processor 151 performs a process of determining the presence or absence of toner or the remaining amount of toner in the sub hopper 115. The presence or absence of toner means that toner is present when the toner in the storage unit 1151 is equal to or larger than a predetermined amount and is not present when the toner is less than the predetermined amount. For example, the processor 151 determines that toner is present when the change amount Cpp is equal to or larger than a predetermined threshold. Then, the processor 151 determines that there is no toner when the change amount Cpp is less than the threshold.

The processor 151 obtains the remaining amount of toner by using the change amount Cpp and the like. It is considered that the larger the amount of change in the capacitance C, the more toner. The processor 151 obtains the remaining amount of toner by a function using the change amount Cpp, for example. The processor 151 may obtain the remaining amount of toner using the value of the capacitance C instead of the amount of change in the capacitance.

In ACT 22, the processor 151 determines whether to refill the sub hopper 115 with toner. For example, the processor 151 determines to refill the toner when the result of ACT 21 is no toner. For example, the processor 151 determines to refill the toner when the remaining amount of toner obtained by ACT 21 is equal to or less than a predetermined amount. For example, the processor 151 determines to refill the toner when the change amount Cpp is equal to or less than the threshold THd. If the processor 151 determines to refill the sub hopper 115 with toner, the processor 151 determines Yes in ACT 22 and proceeds to ACT 23. The magnitude relationship between the threshold THc and the threshold THd is THd>THc.

In ACT 23, the processor 151 controls each unit such as the toner cartridge 114 so that the sub hopper 115 is refilled with toner. Based on this control, the toner cartridge 114 supplies toner to the sub hopper 115.

In ACT 24, the processor 151 stores a value indicating that there is toner in the storage unit 1151 or a value indicating that the remaining amount of toner in the storage unit 1151 is full, in the auxiliary storage device 154 or the like. The processor 151 can know the presence or absence of toner or the remaining amount of toner by referring to the value later. After the process of ACT 24, the processor 151 ends the processing shown in FIG. 10.

On the other hand, if the toner is not refilled in the sub hopper 115, the processor 151 determines No in ACT 22 and proceeds to ACT 25.

In ACT 25, the processor 151 stores a value indicating the presence or absence of toner or the remaining amount of toner in the auxiliary storage device 154 or the like based on the result of ACT 21. The processor 151 can know the presence or absence of toner or the remaining amount of toner by referring to the value later. After the process of ACT 25, the processor 151 ends the processing shown in FIG. 10.

The image forming apparatus 100 according to the embodiment includes the rotation mechanism that moves the to-be-detected unit 1153 in the storage unit 1151 that stores toner. The substrate 1155 measures the capacitance C between the first electrode 1156 and the second electrode 1157. When the measured value of the capacitance C is an abnormal value or the amount of change in the capacitance C is equal to or less than a predetermined value, the processor 151 determines that the substrate 1155, the wiring or circuit connecting the substrate 1155, or the rotation mechanism has an abnormality. The image forming apparatus 100 according to the embodiment can detect when there is an abnormality in a portion related to the measurement of the capacitance C.

Since the image forming apparatus 100 according to the embodiment does not use an expensive piezoelectric sensor, the cost can be reduced. Since the image forming apparatus 100 according to the embodiment does not use the piezoelectric sensor that consumes a large amount of power, the power consumption can be reduced. Since the image forming apparatus 100 according to the embodiment uses the change amount Cpp, it is possible to detect the presence or absence of toner or the remaining amount of toner even if the presence or absence of toner in the initial state is unknown.

The image forming apparatus 100 according to the embodiment determines that the rotation mechanism has an abnormality when the amount of change in the capacitance C is equal to or less than a predetermined value. The image forming apparatus 100 according to the embodiment can detect an abnormality in the rotation mechanism.

The image forming apparatus 100 according to the embodiment determines that the substrate 1155 or the wiring or the circuit connecting the substrate 1155 has an abnormality when the measured value of the capacitance C is an abnormal value. The image forming apparatus 100 according to the embodiment can detect an abnormality in the measurement of the capacitance C.

The image forming apparatus 100 according to the embodiment notifies that the rotation mechanism or the substrate 1155 has an abnormality when the measured value of the capacitance C is an abnormal value or when the amount of change in the capacitance C is equal to or less than a predetermined value. The operator and the administrator of the image forming apparatus 100 can know that the rotation mechanism or the substrate 1155 has an abnormality.

The image forming apparatus 100 of the embodiment assumes that the measured value of the capacitance C is an abnormal value when the measured value is less than the threshold THb. The image forming apparatus 100 according to the embodiment can detect that the measured value of the capacitance C is abnormally low.

The image forming apparatus 100 according to the embodiment assumes that the measured value of the capacitance C is an abnormal value when the measured value exceeds the threshold THa. The image forming apparatus 100 according to the embodiment can detect that the measured value of the capacitance C is abnormally high.

In the image forming apparatus 100 of the embodiment, the to-be-detected unit 1153 is attached to the rotator 1154. The image forming apparatus 100 of the embodiment can measure the capacitance C at the same time as or in parallel with the replenishment of the toner to the developer container 11631.

The image forming apparatus 100 according to the embodiment detects an abnormality in the substrate 1155, the wiring or circuit connecting the substrate 1155, or the rotation mechanism when the rotation amount of the rotator 1154 is equal to or larger than a predetermined rotation amount. The image forming apparatus 100 according to the embodiment does not detect an abnormality when the replenishing amount of toner is small, and thus the cost can be reduced by reducing the number of times of abnormality detection.

The above embodiment can be modified as follows.

In the above-described embodiment, the processor 151 determines whether or not the measured value of the capacitance C changes periodically after determining whether or not the measurement result of the capacitance C is within the normal range. The processor 151 may reverse the determination order. For example, if the processor 151 determines Yes in the process of ACT 14, the processor 151 proceeds to ACT 18. If YES is determined in the process of ACT 18, the process proceeds to ACT 15. If the processor 151 determines Yes in the process of ACT 15, the processor 151 proceeds to ACT 21.

In the above embodiment, the processor 151 determines whether or not the measured value of the capacitance C changes periodically when the measured result of the capacitance C is outside the normal range. The processor 151 may perform both of determining whether or not the measurement result of the capacitance C is within the normal range and whether or not the measured value of the capacitance C changes periodically, regardless of the determination results. For example, the processor 151 proceeds to ACT 18 after the process of ACT 17. When proceeding from ACT 17 to ACT 18, the processor 151 skips the processes of ACT 21 and ACT 25 if Yes is determined in ACT 18.

In the above embodiment, the processor 151 determines that there is an abnormality in the substrate 1155 or the wiring or circuit connecting the substrate 1155 when the measurement result of the capacitance C is outside the normal range. If the measurement result of the capacitance C is outside the normal range, the processor 151 may not specify whether the substrate 1155, the wiring or the circuit connecting the substrate 1155 has an abnormal, or the rotation mechanism has an abnormal. When the measurement result of the capacitance C is outside the normal range, the processor 151 may determine that the wiring or circuit connecting the substrate 1155, or the rotation mechanism has an abnormality.

In the above embodiment, the processor 151 determines that the rotation mechanism has an abnormality when the measured value of the capacitance C does not change periodically. The processor 151 may not specify whether the substrate 1155, or the wiring or circuit connecting the substrate 1155 has an abnormality, or the rotation mechanism has an abnormality when the measured value of the capacitance C does not change periodically. When the measured value of the capacitance C does not change periodically, the processor 151 may determine that the wiring or circuit connecting the substrate 1155 or the rotation mechanism has an abnormality.

The to-be-detected unit 1153 may be made of a conductor.

Figure 12:
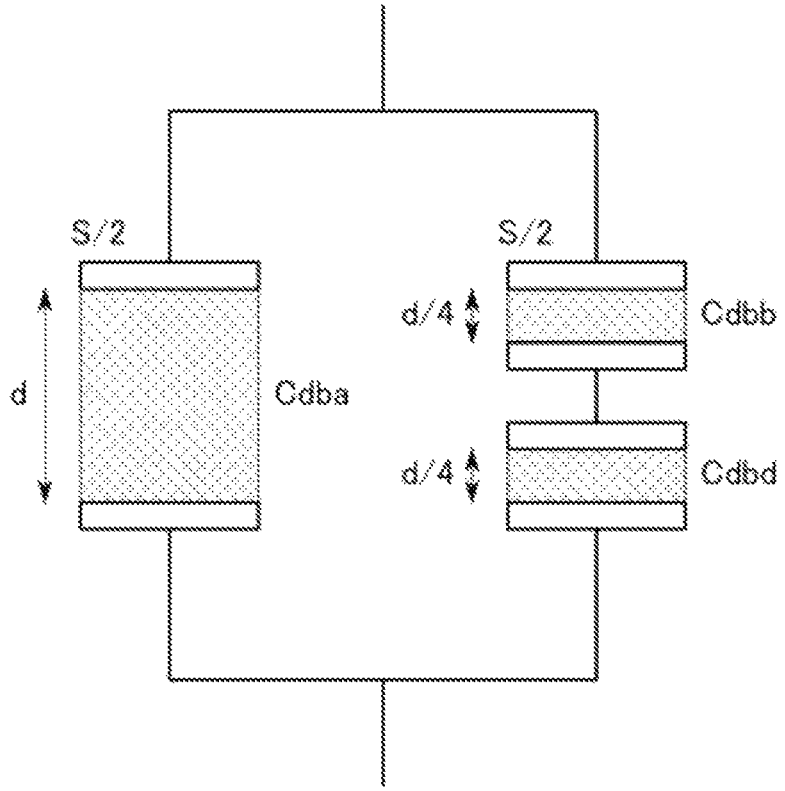
FIG. 12 is a diagram in which the capacitance Cdb in the state where a to-be-detected unit made of a conductor is closest to the first electrode and the second electrode in FIG. 2 is replaced with a parallel plate capacitor model.

FIG. 12 is a diagram in which the capacitance Cdb in the state where the to-be-detected unit 1153 made of a conductor is closest to the first electrode 1156 and the second electrode 1157 is replaced with a parallel plate capacitor model.

In the model shown in FIG. 12, unlike the model shown in FIG. 9, the capacitance of the portion where the lines of electric force pass through the to-be-detected unit 1153 is the capacitance when the capacitor having the capacitance Cdbb and the capacitor having the capacitance Cdbd are connected in series. This is because the to-be-detected unit 1153 works as an electrode. Therefore, the capacitance Cdb can be expressed by:

$$Cdb \approx Cdba + 1/(1/Cdbb + 1/Cdbd) \tag{9}$$

Further, Equation (9) can be expressed by:

$$Cdb \approx \varepsilon\varepsilon_0 S/2d + 1/(1/(2\varepsilon\varepsilon_0 S/d) + 1/(2\varepsilon\varepsilon_0 S/d)) \tag{10}$$

When Equation (10) is arranged, it becomes:

$$Cdb \approx (3/2)\varepsilon\varepsilon_0(S/d) \tag{11}$$

In this case, the difference Cdif between the capacitance Cdb when the to-be-detected unit 1153 is sufficiently separated from the first electrode 1156 and the second electrode 1157, and the capacitance Cdb when the to-be-detected unit 1153 is closest to the first electrode 1156 and the second electrode 1157 becomes as follows from Equations (3) and (11):

$$Cdif \approx (1/2)\varepsilon\varepsilon_0(S/d) \tag{12}$$

Therefore, even when the to-be-detected unit 1153 is made of a conductor, it can be understood that the change amount of the capacitance C due to the movement of the to-be-detected unit 1153 becomes large as the relative dielectric constant of the substance SU is higher, as in the case where the to-be-detected unit 1153 is made of a dielectric material. Since the relative dielectric constant of toner is higher than the relative dielectric constant of air, it is understood that when the storage unit 1151 is filled with toner, the amount of change in the capacitance C increases due to the movement of the to-be-detected unit 1153 more than when the storage unit 1151 is empty.

It is considered that the to-be-detected unit 1153 is less likely to be charged if the to-be-detected unit 1153 is made of a dielectric material. Therefore, from the viewpoint of suppressing the influence of the change in the capacitance C and the like due to the to-be-detected unit 1153 being charged, it is considered that the to-be-detected unit 1153 is preferably made of a dielectric material.

The to-be-detected unit 1153 may be attached to a rotator different from the rotator 1154. In this case, the rotator to which the to-be-detected unit 1153 is attached and the motor that rotates the rotator are examples of a rotating unit.

The developer in the above embodiment is a two-component developer composed of toner and carrier. The developer may be a developer composed of only one component of toner. The developer may be a developer of other components or a developer composed of three or more components.

The image forming apparatus of the embodiment may detect the presence or absence or the remaining amount of the developer in the developing unit by using the mechanism in the above embodiment. The image forming apparatus according to the embodiment may detect an abnormality in the portion that detects the presence or absence or the remaining amount of the developer by using the mechanism in the above embodiment. The developing unit includes, for example, the first electrode, the second electrode, and the substrate on the outer wall of the wall surface, and the rotator and the to-be-detected unit inside the developing unit. The developing unit may use a stirring mechanism as a rotator. The developing unit in the above-described embodiment usually does not run out of the developer. This is useful in a developing unit where a one-component developer containing toner only is used because the developer in the developing unit decreases.

The image forming apparatus of the embodiment may detect the presence or absence or the remaining amount of toner in the toner cartridge by using the mechanism in the above embodiment. The image forming apparatus according to the embodiment may detect an abnormality in the portion that detects the presence or absence or the remaining amount of toner in the toner cartridge by using the mechanism in the above embodiment. The toner cartridge includes, for example, the first electrode, the second electrode, and the substrate on the outer wall of the wall surface, and the rotator and the to-be-detected unit inside the developing unit. The toner cartridge may use a stirring mechanism as a rotator.

In the image forming apparatus 100 according to the above-described embodiment, the to-be-detected unit 1153 is circularly moved on the same circumference around the rotary axis. The moving path of the to-be-detected unit 1153 is not limited to the same circumference around the rotary axis. For example, the image forming apparatus of the embodiment may reciprocate the to-be-detected unit 1153.

The capacitance C increases when the distances between the to-be-detected unit 1153 and both the first electrode 1156 and the second electrode 1157 decrease. The capacitance C decreases when the distances between the to-be-detected unit 1153 and both the first electrode 1156 and the second electrode 1157 increase. The capacitance decreases even when the distance between the to-be-detected unit 1153 and one electrode is constant and only the distance between the to-be-detected unit 1153 and the other electrode increases. The capacitance increases even when the distance between the to-be-detected unit 1153 and one electrode is constant and only the distance between the to-be-detected unit 1153 and the other electrode decreases. It is considered that the moving path of the to-be-detected unit 1153 may be a path in which the distance to at least one of the first electrode 1156 and the second electrode 1157 changes. It is considered that when the moving path of the to-be-detected unit 1153 is a path in which the distances to both the first electrode 1156 and the second electrode 1157 change, the change amount of the capacitance is larger.

The method of moving the to-be-detected unit 1153 may be a method of moving by using gravity or buoyancy applied to the to-be-detected unit.

The image forming apparatus of the embodiment may be configured to directly supply the toner from the toner cartridge to the developing unit.

The image forming apparatus in the above embodiment detects the presence or absence or the remaining amount of toner. The image forming apparatus according to the embodiment may detect the presence or absence or the remaining amount of substance other than toner. The image forming apparatus according to the embodiment may detect an abnormality in a portion that detects the presence or absence or the remaining amount of substance other than toner by using the mechanism in the above embodiment. For example, the image forming apparatus according to the embodiment may detect the presence or absence or the remaining amount of ink. The printer included in the image forming apparatus is, for example, an inkjet printer that uses ink as a recording material. The image forming apparatus detects, for example, the presence or absence or the remaining amount of ink in an ink cartridge, an ink tank, or an inkjet head that stores ink. An inkjet printer may eject a liquid containing conductive particles for forming a wiring pattern of a printed wiring board, a liquid containing cells for artificially forming a tissue or an organ, a binder such as an adhesive, a wax, or a resin in the liquid state. The inkjet printer is not limited to one that forms a two-dimensional image and may be a 3D (three-dimensional) printer or an industrial manufacturing machine.

In the above embodiment, the case where the presence or absence or the remaining amount of toner is detected is described. It is also possible to detect the presence or absence or the remaining amount of other substances by using the above mechanism. It is also possible to detect an abnormality of the portion that detects the presence or absence or the remaining amount of the other substance by using the mechanism in the above embodiment. The device for detecting the presence or absence of other substances can detect the presence or absence or the remaining amount of powder other than toner, liquid other than ink, gas, solid, or dispersion system in the storage unit. As the relative dielectric constant is closer to 1, it is more difficult to detect. The substance to be detected needs to have a relative dielectric constant sufficiently larger than 1.

The processor 151 may realize some or all of the processing realized by the program in the above embodiment by a hardware configuration of a circuit.

Each device in the above embodiment is transferred to, for example, an administrator of each device in a state where a program for executing each of the above processes is stored. Alternatively, each device is transferred to the administrator or the like in a state where the program is not stored. Then, the program is separately transferred to the administrator or the like and stored in each device based on the operation by the administrator or a service person. The transfer of the program at this time can be realized by using a removable storage medium such as a disk medium or a semiconductor memory, or by downloading the program via the Internet or LAN, for example.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. A image forming apparatus, comprising:

a storage unit configured to store a recording material;

an image forming device configured to form an image with the recording material supplied from the storage unit;

a first electrode;

a second electrode;

a to-be-detected dielectric in the storage unit and movable so that the distance to the first electrode and the distance to the second electrode changes;

a moving component configured to move the to-be-detected dielectric in the storage unit;

a measuring component configured to measure a capacitance between the first electrode and the second electrode; and a processor configured to perform control based on an abnormality detected based on the capacitance.

2. The apparatus according to claim 1, wherein the processor detects the abnormality based on an amount of change in the capacitance.

3. The apparatus according to claim 1, wherein the processor detects that the capacitance is less than a first threshold as the abnormality.

4. The apparatus according to claim 1, wherein the processor detects that the capacitance exceeds a second threshold as the abnormality.

5. The apparatus according to claim 1, wherein the moving component rotates the to-be-detected dielectric so that the distance changes.

6. The apparatus according to claim 1, wherein the moving component rotates to supply the recording material to the image forming device and move the to-be-detected dielectric so that the distance changes.

7. The apparatus according to claim 6, wherein the processor detects an abnormality based on the capacitance when a rotation amount of the moving component is equal to or larger than a predetermined amount.

8. The apparatus according to claim 1, wherein the to-be-detected dielectric comprises a dielectric material.

9. The apparatus according to claim 1, further comprising:

a retaining unit configured to retain a recording material supplied to the storage unit, wherein the processor controls the supply of the recording material from the retaining unit to the storage unit according to a change in the capacitance measured by the measuring component.

10. The apparatus according to claim 1, further comprising:

a notification component configured to notify that the processor detects the abnormality, wherein the processor controls the notification component based on the abnormality detected based on the capacitance.

11. A method, comprising:

forming an image with a recording material supplied from a storage unit;

moving a to-be-detected dielectric in the storage unit so that a distance to a first electrode and a distance to a second electrode changes;

measuring a capacitance between the first electrode and the second electrode; and performing control, by a processor, based on an abnormality detected based on the capacitance.

12. The method according to claim 11, further comprising:

detecting the abnormality based on an amount of change in the capacitance.

13. The method according to claim 11, further comprising:

detecting that the capacitance is less than a first threshold as the abnormality.

14. The method according to claim 11, further comprising:

detecting that the capacitance exceeds a second threshold as the abnormality.

15. The method according to claim 11, further comprising:

rotating to supply the recording material and move the to-be-detected dielectric so that the distance changes.

16. The method according to claim 15, wherein detecting the abnormality is based on the capacitance when a rotation amount is equal to or larger than a predetermined amount.

17. The method according to claim 11, further comprising:

controlling the supply of the recording material to the storage unit according to a change in the capacitance measured.

18. A toner monitor, comprising:

a storage unit configured to store toner;

a first electrode;

a second electrode;

a to-be-detected dielectric in the storage unit and movable so that a distance to the first electrode and a distance to the second electrode changes;

a moving component configured to move the to-be-detected dielectric in the storage unit;

a measuring component configured to measure a capacitance between the first electrode and the second electrode; and a processor configured to perform control based on an abnormality detected based on the capacitance.

19. The toner monitor according to claim 18, wherein the moving component rotates to supply the toner and move the to-be-detected dielectric so that the distance changes.

20. The toner monitor according to claim 19, wherein the processor detects an abnormality based on the capacitance when a rotation amount of the moving component is equal to or larger than a predetermined amount.

* * * * *